US007703708B2

(12) United States Patent
Matsumoto

(10) Patent No.: US 7,703,708 B2
(45) Date of Patent: Apr. 27, 2010

(54) FUEL INJECTION VALVE

(75) Inventor: Shuichi Matsumoto, Kariya (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 11/729,970

(22) Filed: Mar. 30, 2007

(65) Prior Publication Data

US 2007/0228185 A1 Oct. 4, 2007

(30) Foreign Application Priority Data

Apr. 3, 2006 (JP) ..... 2006-102391

(51) Int. Cl.
*F02M 39/00* (2006.01)

(52) U.S. Cl. ..... 239/533.3; 239/96; 239/102.2

(58) Field of Classification Search ..... 239/96, 239/533.3, 89–95, 102.2, 533.2, 533.4–533.12, 239/584, 585.1, 88
See application file for complete search history.

(56) References Cited

U.S. PATENT DOCUMENTS

| | | | | | |
|---|---|---|---|---|---|
| 3,913,537 | A * | 10/1975 | Ziesche et al. | ..... | 123/484 |
| 4,597,558 | A * | 7/1986 | Hafner et al. | ..... | 239/585.1 |
| 4,684,067 | A * | 8/1987 | Cotter et al. | ..... | 239/533.3 |
| 4,946,106 | A * | 8/1990 | Turchi et al. | ..... | 239/585.3 |
| 5,241,935 | A * | 9/1993 | Beck et al. | ..... | 123/300 |
| 5,873,526 | A * | 2/1999 | Cooke | ..... | 239/88 |
| 6,745,993 | B2 * | 6/2004 | Mueller | ..... | 251/50 |
| 6,837,450 | B2 * | 1/2005 | Boecking | ..... | 239/533.2 |
| 6,971,592 | B2 * | 12/2005 | Boecking | ..... | 239/533.2 |
| 2007/0170286 | A1 | 7/2007 | Boecking | | |

FOREIGN PATENT DOCUMENTS

| | | |
|---|---|---|
| DE | 100 29 297 | 10/2001 |
| DE | 100 24 703 | 11/2001 |
| DE | 103 46 222 A1 | 4/2005 |
| DE | 10 2004 045 249 A1 | 3/2006 |
| FR | 2 331 693 | 6/1977 |
| JP | 59-93934 | 5/1984 |
| WO | WO 2006/029917 A1 | 3/2006 |

OTHER PUBLICATIONS

Chinese Office Action dated Dec. 5, 2008 issued in corresponding Chinese Application No. 200710092155.2 with English Translation.
Japanese Office Aciton dated Sep. 1, 2009, issued in corresponding Japanese Application No, 2006-102391, with English translation.

* cited by examiner

*Primary Examiner*—Christopher S Kim
(74) *Attorney, Agent, or Firm*—Nixon & Vanderhye PC

(57) ABSTRACT

A fuel injection valve includes a nozzle body and a plate. The nozzle body includes an injection orifice, through which fuel is injected, a needle that controls the injection through the injection orifice, and a needle-receiving bore that receives the needle. The plate is adjacently provided to the nozzle body for defining a fuel passage therein, through which fuel is supplied to the needle-receiving bore. The plate has an annular groove, which connects the fuel passage with the needle-receiving bore, at an end surface of the plate toward the nozzle body.

17 Claims, 3 Drawing Sheets

FUEL INJECTION VALVE

CROSS REFERENCE TO RELATED APPLICATION

This application is based on and incorporates herein by reference Japanese Patent Application No. 2006-102391 filed on Apr. 3, 2006.

BACKGROUND OF THE INVENTION

1. Field of the Invention

The present invention relates to a fuel injection valve.

2. Description of Related Art

Conventionally, there has been known a fuel injection valve, which includes a nozzle body and a plate. Here, the nozzle body includes an injection orifice, through which fuel is injected, and a needle-receiving bore, which receives a needle controlling the injection through the injection orifice. Also, the plate is adjacently provided to the nozzle body for defining a fuel passage, through which fuel is supplied to the needle-receiving bore (see DE Patent Application Publication No. 10023952, which corresponds to US Patent Application Publication No. 2004/0060998, DE Patent Application Publication No. 10024703, and DE Patent Application Publication No. 10029297).

In the above fuel passage of the fuel injection valve disclosed in the above publications, fuel is required to be supplied to an outer periphery of a needle, which is received in a needle-receiving bore along an axial center thereof. Therefore, the fuel passage is formed in the plate, and is displaced from the needle-receiving bore. Also, the needle-receiving bore is provided with a cut, which connects the needle-receiving bore and the fuel passage.

However, because the above fuel injection valve includes the cut, when the injection pressure for injection becomes high, a stress is concentrated on the cut portion, thereby, a pressure resistance performance of the nozzle body may disadvantageously decrease. In contrast, in order to avoid formation of the cut, an inner diameter of the needle-receiving bore may be enlarged instead. However, if a magnitude of an outer diameter of the nozzle body is kept as it is in this case (i.e., if the magnitude of the outer diameter of the nozzle body is not changed even when the inner diameter of the needle-receiving bore is enlarged), a thickness of the nozzle body is decreased, thus the pressure resistance performance being reduced.

SUMMARY OF THE INVENTION

The present invention is made in view of the above disadvantages. Thus, it is an objective of the present invention to address at least one of the above disadvantages.

To achieve the objective of the present invention, there is provided a fuel injection valve, which includes a nozzle body and a plate. The nozzle body includes an injection orifice, through which fuel is injected, a needle that controls the injection through the injection orifice, and a needle-receiving bore that receives the needle. The plate is adjacently provided to the nozzle body for defining a fuel passage therein, through which fuel is supplied to the needle-receiving bore. The plate has an annular groove, which connects the fuel passage with the needle-receiving bore, at an end surface of the plate toward the nozzle body.

To achieve the objective of the present invention, there is also provided a fuel injection valve, which includes a nozzle body and a plate. The nozzle body includes an injection orifice, through which fuel is injected, a needle that controls the injection through the injection orifice, and a needle-receiving bore that receives the needle. The plate is adjacently provided to the nozzle body for defining a fuel passage therein, through which fuel is supplied to the needle-receiving bore. The plate has a groove, which connects the fuel passage with the needle-receiving bore, at an end surface of the plate toward the nozzle body. The groove has a length in a circumferential direction and a width such that an area of an overlapping section between the needle-receiving bore and an opening portion of the groove is equal to or greater than an area of a passage cross section of the fuel passage.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF PREFERRED EMBODIMENTS

A best mode for carrying out the present invention will be described in detail with reference to the below embodiments.

Figure 1:
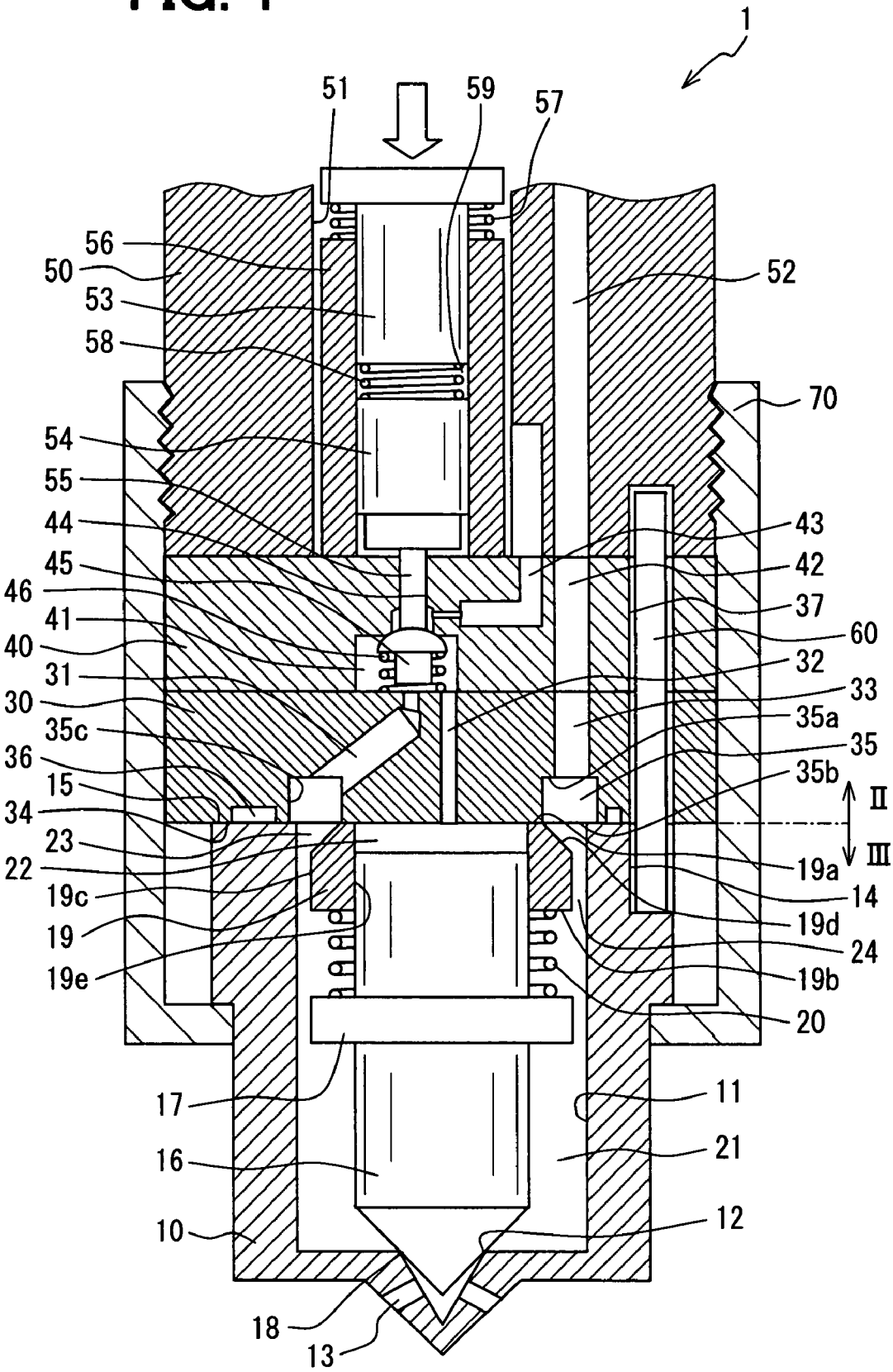
FIG. 1 is a cross-sectional view of a main portion of a fuel injection valve according to one embodiment of the present invention, the view being taken along line I-I of FIG. 2.

A fuel injection valve 1 shown in FIG. 1 is used for, example, an accumulator fuel injection system for a diesel engine to injects high pressure fuel supplied from a common rail (not shown) into cylinders of the diesel engine. Also, the fuel injection valve 1 includes a nozzle portion, a back pressure controller, and a piezo actuator. The nozzle portion includes a nozzle body 10, a needle 16, a cylinder 19, and a nozzle spring 20. Here, the needle 16 is slidably supported by the nozzle body 10, and the cylinder 19 receives the needle 16. Also, the nozzle spring 20 biases the needle 16 in a closing direction.

The nozzle body 10 is a cylindrical body with a bottom, which has a needle-receiving bore 11. Here, the needle-receiving bore 11 receives the needle 16, the cylinder 19, and the nozzle spring 20 at a generally center portion thereof. The nozzle body 10 includes injection orifices 13 at a bottom portion thereof, through which high pressure fuel is injected into a cylinder of the diesel engine. A valve seat 12, which has a mortar-like shape, is formed at an upstream side of the injection orifices 13.

The needle 16 a generally cylindrical valve element having a conical seat portion 18 at a tip end for controlling whether or not the high pressure fuel is injected through the injection orifices 13. The needle 16 is reciprocably provided, and when the seat portion 18 is engaged with and disengaged from the valve seat 12, injection of the high pressure fuel through the injection orifices 13 can be controlled. Then, the needle 16 includes a flange 17 at a midway portion thereof, which contacts one end of the nozzle spring 20 and admits a biasing force by the nozzle spring 20.

The cylinder 19 is a generally cylindrical member, and is received by the needle-receiving bore 11 similarly to the needle 16. The cylinder 19 has an inner peripheral wall 19*e*, which slidably supports an upper portion of the needle 16. The cylinder 19 has an outer peripheral wall 19*c*, and a gap is formed between the outer peripheral wall 19*c* and an inner wall of the needle-receiving bore 11. The cylinder 19 has a lower end surface 19*b*, which opposes the flange 17, and supports the other end of the nozzle spring 20. The outer peripheral wall 19*c* of the cylinder 19 includes an inclined surface 19*d* at a side toward an the upper end surface 19*a*, and an outer diameter of the inclined surface 19*d* becomes smaller toward the upper end surface 19*a*.

There is provided a plate 30 configured of a circular column above the nozzle body 10 such that a plate-side end surface 15 of the nozzle body 10 closely contacts a body-side end surface 34 of the plate 30 (i.e., an end surface 15 of the nozzle body 10 toward the plate 30 closely contacts an end surface 34 of the plate 30 toward the nozzle body 10). When the needle 16 is received by the needle-receiving bore 11 in a state, where the needle 16 is also received by the cylinder 19, the needle-receiving bore 11 is divided into three spaces, i.e., a back pressure chamber 22, a high-pressure chamber 21, an annular passage 23.

As shown in FIG. 1, the back pressure chamber 22 is a space defined by an upper end surface of the needle 16, the inner peripheral wall 19*e* of the cylinder 19, and the body-side end surface 34 of the plate 30. When fuel with a predetermined pressure is introduced into the space and the pressure is changed, this changes a force, which urges the needle 16 toward the injection orifices 13.

The annular passage 23 is a space defined by the inner wall of the needle-receiving bore 11 and the inclined surface 19*d* of the cylinder 19. The high pressure fuel in the common rail is supplied to the annular passage 23 at least during an operation of the diesel engine.

The high-pressure chamber 21 is a space defined by the inner wall of the needle-receiving bore 11 and the lower end surface 19*b* of the cylinder 19. The high-pressure chamber 21 communicates with the annular passage 23 through a fourth high pressure fuel passage 24, and also communicates with the injection orifices 13. Here, the fourth high pressure fuel passage 24 is defined by the outer peripheral wall 19*c* of the cylinder 19 and the inner wall of the needle-receiving bore 11, which opposes the outer peripheral wall 19*c*. Therefore, the high-pressure chamber 21 is supplied with the high pressure fuel inside the common rail through the fourth high pressure fuel passage 24 at least during the operation of the diesel engine. When the seat portion 18 of the needle 16 is disengaged from the valve seat 12, the high pressure fuel is injected through the injection orifices 13. Here, the fourth high pressure fuel passage 24 corresponds to "a smallest gap between an outer peripheral wall of the cylinder and an opposing inner wall of the needle-receiving bore opposing the outer peripheral wall" of the present invention.

The back pressure controller, which controls pressure in the back pressure chamber 22, includes the plate 30, a valve plate 40, a valve element 45, and a spring 46. The plate 30 and the valve plate 40 include various fuel passages for controlling pressure in the back pressure chamber 22 and for supplying fuel to the annular passage 23 and the high-pressure chamber 21. Also, the plate 30 and the valve plate 40 include a valve chamber 41 for receiving the valve element 45. The plate 30 is provided adjacently to the nozzle body 10, and the valve plate 40 is provided adjacently to the plate 30.

The plate 30 is a generally cylindrical column member, and internally defines a third high pressure fuel passage 33, a first communication passage 31, and a second communication passage 32. The third high pressure fuel passage 33 is a passage, through which the high pressure fuel in the common rail is supplied to the annular passage 23, and is defined to extend in a longitudinal direction fuel injection valve 1. The first communication passage 31 serves as a passage, through which the high pressure fuel is supplied to the valve chamber 41 formed in the valve plate 40, and the second communication passage 32 is a passage, which provides communication between the valve chamber 41 and the back pressure chamber 22. Here, the third high pressure fuel passage 33 serves as a fuel passage of the present invention.

The valve plate 40 includes the valve chamber 41, a low pressure fuel passage 43, and a second high pressure fuel passage 42. Here, the valve chamber 41 receives the valve element 45, and fuel in the valve chamber 41 is discharged toward a low pressure side through the low pressure fuel passage 43. Also, the high pressure fuel in the common rail is supplied to the third high pressure fuel passage 33 through the second high pressure fuel passage 42. The valve chamber 41 is connected with the first communication passage 31, the second communication passage 32, a valve-needle receiving bore 44, and the low pressure fuel passage 43. The valve element 45 has a function of, so-called, a three way valve, and serves as a control valve, which reciprocates between a first position and a second position. Here, when the valve element 45 is at the first position, the high pressure fuel in the first communication passage 31 is permitted to be supplied to the back pressure chamber 22 through the second communication passage 32. In contrast, when the valve element 45 is at the second position, fuel in the back pressure chamber 22 is discharged to the low pressure fuel passage 43. Also, the valve chamber 41 is provided with the spring 46, which biases the valve element 45 toward the first position.

The valve element 45 is received by the valve-needle receiving bore 44, and contacts a valve needle 55, which transmits a drive force by the piezo actuator to the valve element 45. When the valve needle 55 reciprocates, the valve element 45 is controlled to be located at the first position and second position.

The piezo actuator includes a low pressure chamber 51, a first high pressure fuel passage 52, a piezo stack (not shown), and a drive force transmitter. Here, the low pressure chamber 51 is provided adjacently to the valve plate 40 inside a valve body 50, and is filled with low pressure fuel. Also, the high pressure fuel in the common rail is supplied to the second high pressure fuel passage 42 through the first high pressure fuel passage 52, and the piezo stack is received at the upper portion of the low pressure chamber 51. Also, the drive force transmitter is received below the piezo stack.

The low pressure chamber 51 is a longitudinal bore, which is formed inside the valve body 50 to have a circular cross section. Here, the longitudinal bore opens at a lower end surface of the valve body 50 and is defined by provision of the valve plate 40 to close the opening portion of the longitudinal bore. The low pressure chamber 51 communicates with the valve chamber 41 through the valve-needle receiving bore 44, and communicates with the valve chamber 41 also through the low pressure fuel passage 43, separately from the valve-needle receiving bore 44. Furthermore, the low pressure chamber 51 is connected to a passage, which communicates with a fuel tank (not shown).

The piezo stack is a general piezo stack, which has, for example, a capacitor structure, where piezoelectric ceramic layers (e.g., PZT) and electrode layers are alternately laminated. Also, the piezo stack is charged and discharged by a drive circuit (not shown). When the piezo stack is charged and discharged, the piezo stack contracts and expands in an up-down direction of FIG. 1.

The drive force transmitter, which transmits a displacement of the piezo stack to a valve needle 55, includes a piston cylinder 56, a first piston 53, a second piston 54, an oil-tight chamber 59, a first piston spring 57, and a second piston spring 58. The piston cylinder 56 is provided inside the low pressure chamber 51, and the first piston 53 and the second piston 54 are received by the cylinder 56. The oil-tight chamber 59 is provided between both the first and second pistons 53, 54. The first piston spring 57 is provided in the oil-tight chamber 59, and has one end supported by the first piston 53 and the other end supported by the piston cylinder 56 for generating a bias force biasing the first piston 53 and the piston cylinder 56 in directions away from each other. Also, the second piston spring 58 generates a bias force biasing both the first and second pistons 53, 54 in directions away from each other.

The first piston 53 is provided at a lower side of the piezo stack, and is urged against a lower end portion of the piezo stack by the first piston spring 57. The first piston 53 reciprocates inside the piston cylinder 56 in accordance with the displacement of the piezo stack.

The second piston 54 is provided lower (lower in FIG. 1) than the first piston 53 via the oil-tight chamber 59, and reciprocates within the piston cylinder 56 in accordance with the displacement of the first piston 53. Also, the valve needle 55 is positioned lower (lower in FIG. 1) than the second piston 54 such that the valve needle 55 reciprocates in accordance with the displacement of the second piston 54. Then, the reciprocation of the valve needle 55 is transmitted to the valve element 45, and therefore, the valve element 45 reciprocates within the valve chamber 41 to be located at the first and second positions under control.

Figure 4:
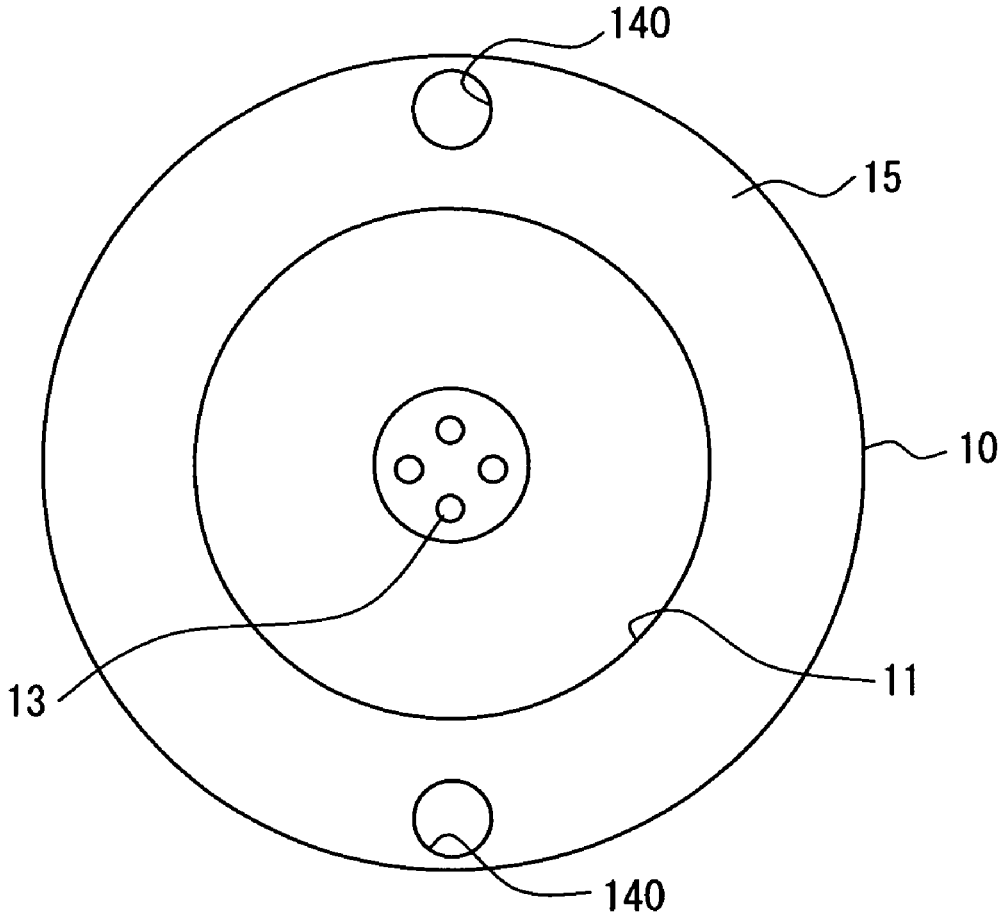
FIG. 4 is a plan view of an alternate embodiment of a plate-side end surface of a nozzle body of the fuel injection valve shown in FIG. 1.

Pin holes 37 and pin grooves 14 are provided at the nozzle body 10, the plate 30, the valve plate 40, and the valve body 50 for engaging with pins 60, which circumferentially position each of the components relative to each other. After each of the components are assembled in the longitudinal direction, the pin holes 37 and the pin grooves 14 are engaged with the pins 60 such that each of the components are fixed circumferentially. Moreover, a retaining nut 70 fixes each of the components strongly. Here, in the present embodiment, only the nozzle body 10 includes the pin grooves 14, and the pin grooves 14 may be alternatively holes 140, as shown in FIG. 4, similar to those formed in the plate 30.

Next, an operation of the fuel injection valve 1 of the above structure will be described.

When the piezo stack is energized through the drive circuit, and the piezo stack expands, the displacement of the piezo stack is transmitted to the second piston 54 from the first piston 53 through fuel in the oil-tight chamber 59. Then, the displacement is transmitted to the valve needle 55. As a result, the valve needle 55 is displaced in the valve-needle receiving bore 44 away from the low pressure chamber 51 (i.e., downward in FIG. 1) such that the valve element 45 is displaced from the first position to the second position.

Then, the communication of fuel from the first communication passage 31 to the second communication passage 32 is closed, and thereby fuel in the back pressure chamber 22 is discharged to the low pressure fuel passage 43. As a result, pressure in the back pressure chamber 22 decreases, and thus a force (valve closing force) for urging the needle 16 toward the injection orifices 13 becomes lower than a force (valve opening force) made by pressure of the fuel supplied to the high-pressure chamber 21 for urging (lifting) the needle 16 away from injection orifices 13. Therefore, the seat portion 18 is disengaged from the valve seat 12, and fuel in the high-pressure chamber 21 is injected through the injection orifices 13.

Subsequently, when the piezo stack is deenergized, an electrical charge in the piezo stack is discharged such that the piezo stack contracts. Then, the force applied to the valve needle 55 through the drive force transmitter is removed. Therefore, the valve element 45 is displaced to the first position by the bias force of the spring 46 and by pressure of the high pressure fuel through the first communication passage 31. Thus, the high pressure fuel is supplied to the back pressure chamber 22 through the first and second communication passages 31, 32. As a result, because pressure in the back pressure chamber 22 increases again, the seat portion 18 gets engaged with the valve seat 12 when the valve closing force exceeds the valve opening force. Thus, the injection of fuel through the injection orifices 13 ends.

Figure 2:
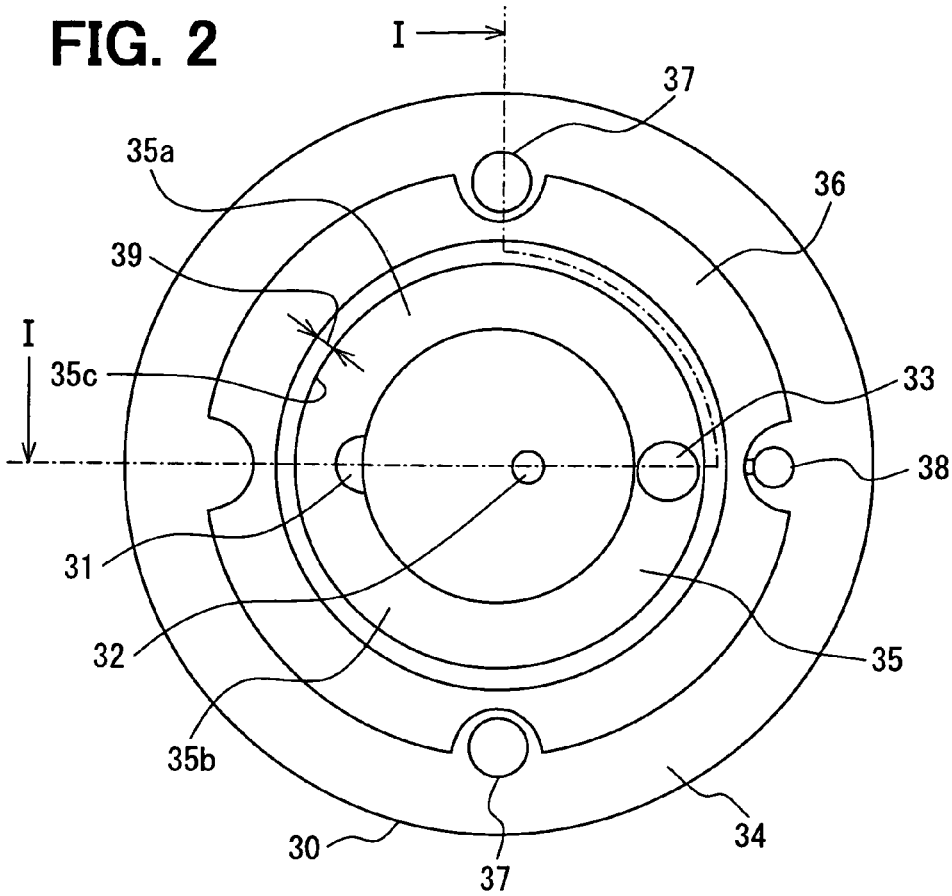
FIG. 2 is a plan view of a body-side end surface of a plate of the fuel injection valve shown in FIG. 1.
Figure 3:
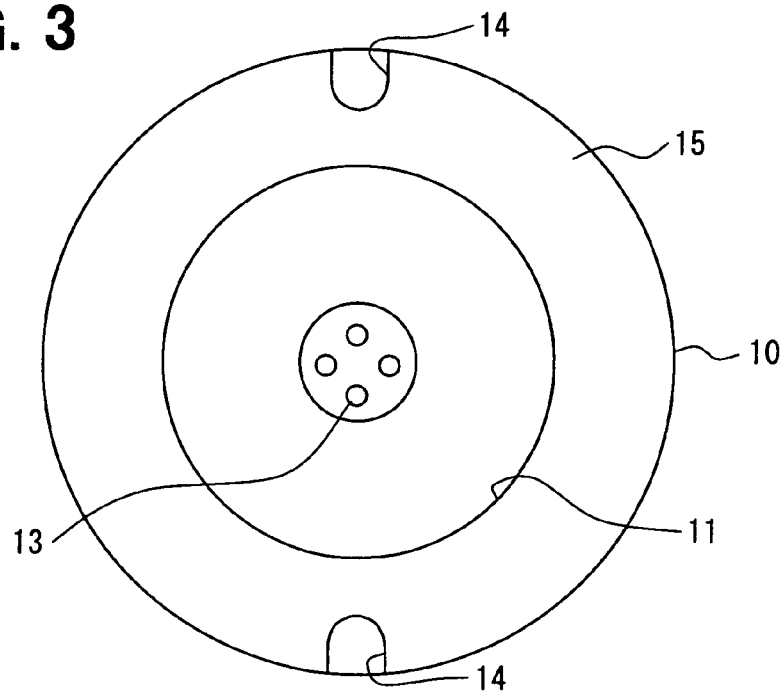
FIG. 3 is a plan view of a plate-side end surface of a nozzle body of the fuel injection valve shown in FIG. 1.

The plate 30 will be described in detail below. FIG. 2 is a plan view of the body-side end surface 34 of the plate 30, and FIG. 3 is the plate-side end surface 15 of the nozzle body 10. As shown in FIG. 2, the body-side end surface 34 of the plate 30 has an the annular groove 35, which includes a bottom portion 35*a* and an opening portion 35*b*. The bottom portion 35*a* is connected to the third high pressure fuel passage 33 and the first communication passage 31. In a state, where the plate-side end surface 15 of the nozzle body 10 is contacts the body-side end surface 34 of the plate 30, the opening portion 35*b* opposes the annular passage 23.

In the case, where the annular groove 35 is provided to the plate 30 as above, there is no need for providing a cut at the needle-receiving bore 11, through which cut, fuel from the high pressure fuel passage is supplied to the nozzle body. Also, without enlarging an inner diameter of the needle-receiving bore 11, an area of a passage, through which fuel is supplied to the annular passage 23 and also to the high-pressure chamber 21, which are formed in the needle-receiving bore 11, can be formed larger than a cross sectional area of the third high pressure fuel passage 33. Thus, for example, even when the needle-receiving bore 11 is positioned offset relative to the third high pressure fuel passage 33, which is formed in the plate 30, the annular groove 35 can provide the fuel passage for the fuel from the third high pressure fuel passage 33 to the needle-receiving bore 11.

As a result, because a thickness of the nozzle body 10 can be sufficiently retained, the pressure resistance performance of the nozzle body 10 can be limited from decreasing.

Also, because the fuel injection valve 1 of the present embodiment has a structure, where the decrease in the pressure resistance performance is limited, for example, the fuel injection valve 1 may be suitable for a fuel injection system of a system pressure equal to or more than 180 MPa.

When the area of the passage (i.e., an overlapping section (communicating section) between the opening portion 35*b* of the annular groove 35 and the opening portion of the needle-receiving bore 11) is achieved to be equal to or more than an area of the passage cross section of the third high pressure fuel passage 33, the high pressure fuel can be supplied to the annular passage 23 and the high-pressure chamber 21 without decreasing a flow rate (e.g., volume per unit time) of the high pressure fuel, which circulates in the third high pressure fuel passage 33. Here, the fuel communicates between the opening portion 35*b* of the annular groove 35 and the opening portion of the needle-receiving bore 11 through the communication area.

In the present embodiment, the annular groove 35 is provided in the plate 30 as a specific means for achieving the above area of the passage. Here, the groove does not have to have an annular shape, but the groove may alternatively have a length in a circumferential direction and a width to some extent, when the above concept is considered. The groove has the annular shape in the present embodiment because generation of burrs while the groove is machined in the plate 30 can be reduced if the groove has the annular (ring) shape.

Also, the width of the annular groove 35 is preferably equal to or more than a diameter of the third high pressure fuel passage 33. In this structure, the machining can be facilitated because the generation of the burrs are limited during the formation of the annular groove 35.

Further, the width and the depth of the annular groove 35 is preferably a width and a depth such that a sum of the area of the cross section of the annular passage 23 in a circumferential direction and the area of the cross section of the annular groove 35 in the circumferential direction becomes equal to or more than ½ of an area of the passage cross section of the third high pressure fuel passage 33. Furthermore, it is preferable that the width of the annular groove 35 is equal to or more than a passage diameter of the third high pressure fuel passage 33. Here, for example, the width of the annular groove 35 is a length of the annular groove 35 in a radial direction (left-right direction in FIG. 1), and the depth of the annular groove 35 is a length of the annular groove 35 in a longitudinal direction (up-down direction in FIG. 1). Also, the cross section of the annular groove 35 in the circumferential direction is a plane defined by the above width and the depth of the annular groove 35 (a cross section of the annular groove 35 shown in FIG. 1).

Due to this, the high pressure fuel, which circulates in the third high pressure fuel passage 33, can be sufficiently supplied to the annular groove 35 and the annular passage 23, and a large amount of the high pressure fuel can be supplied to the high-pressure chamber 21 through the fourth high pressure fuel passage 24.

The plate 30, the valve plate 40, the valve body 50, and the nozzle body 10 are positioned relative to each other in a circumferential direction because the pin holes 37 and the pin grooves 14 engage with the pins 60. However, the above pin holes 37 and the pin grooves 14 may be formed to have dimension errors relative to the corresponding pins 60. In this case, the plate 30 and the nozzle body 10 may be displaced from each other in the radial direction by an amount corresponding to the dimension errors.

In contrast, in the present embodiment, the opening portion 35*b* is designed to be displaced from the pin groove 14 in the radial direction such that the opening portion 35*b* does not face (oppose) the pin groove 14 even when the annular groove 35 is displaced by the amount corresponding to the dimension errors. In other words, for example, the pin grooves 14 (pin holes 37) are separated from the annular groove 35 by a contact face between the body-side end surface 34 of the plate 30 and the plate-side end surface 15 of the nozzle body 10. As a result, this design can limits the opening portion 35*b* of the annular groove 35 from facing the pin groove 14, and can thus limit a decrease in the pressure resistance performance of the nozzle body 10 due to the entrance of the high pressure fuel into the pin groove 14, which has a comparatively weak structure.

Also, in the present embodiment, an outer peripheral wall 35*c* of the annular groove 35 is positioned radially outwardly of the inner wall of the needle-receiving bore 11 in the state, where the plate-side end surface 15 of the nozzle body 10 contacts the body-side end surface 34 of the plate 30.

Also due to the above structure, the thickness of the nozzle body 10, particularly the thickness of the nozzle body 10 around the pin groove 14, is made greater, and therefore the decrease in the pressure resistance performance of the nozzle body 10 can be limited.

Also, a recess 36 is formed at an outer periphery of the annular groove 35 for increasing a contact pressure between the nozzle body 10 and the plate 30. As shown in FIG. 2, the recess 36 includes a leakage passage 38, which communicates with the low pressure fuel passage 43.

Due to this structure, even when the high pressure fuel in the annular groove 35 leaks from the annular groove 35 through a gap between the body-side end surface 34 and the plate-side end surface 15, the leaked fuel can be temporally stored in the recess 36. In the present embodiment, the stored fuel in the recess 36 can be further returned to the fuel tank through the leakage passage 38. As a result, fuel leakage to an exterior of the fuel injection valve 1 can be limited.

Also, the recess 36 is formed on the body-side end surface 34 of the plate 30. That is, the recess 36 is formed on the same end face with the annular groove 35. Due to this, even when the nozzle body 10 is displaced from the plate 30 in the radial direction due to the dimension errors of the pins 60, the pin holes 37 or the pin grooves 14, a distance between the outer peripheral wall 35*c* of the annular groove 35 and the recess 36, that is a sealing length 39 shown in FIG. 2, is not changed. Therefore, a fluid-tight performance can be sufficiently achieved.

Additional advantages and modifications will readily occur to those skilled in the art. The invention in its broader terms is therefore not limited to the specific details, representative apparatus, and illustrative examples shown and described.

What is claimed is:

1. A fuel injection valve comprising:

a nozzle body that includes:

an injection orifice, through which fuel is injected;

a needle that controls the injection through the injection orifice; and a needle-receiving bore that receives the needle, the needle-receiving bore being connected with the injection orifice; and a plate that is adjacently provided to the nozzle body, said plate having a nozzle body-side end surface directly contacting a plate-side end surface of said nozzle body, said plate having a fuel passage therein, through which fuel is supplied to the needle-receiving bore, wherein the plate has an annular groove defined in said nozzle body-side end surface thereof which directly connects the fuel passage with the needle-receiving bore, wherein the annular groove opens to the needle-receiving bore, wherein:

the annular groove has a radially outer peripheral wall which is located radially outward of an inner wall of the needle-receiving bore that defines an opening portion of said needle-receiving bore at said plate-side end surface of said nozzle body.

2. The fuel injection valve according to claim 1, further comprising:

a cylinder that is provided adjacently to the plate, in the needle-receiving bore, the cylinder defining a hollow, in which the needle slides, wherein:

the cylinder divides the needle-receiving bore into an annular passage, which communicates with the annular groove, and a high-pressure chamber, which communicates with the injection orifice, such that a smallest gap between an outer peripheral wall of the cylinder and an opposing inner wall of the needle-receiving bore opposing the outer peripheral wall forms a boundary between the annular passage and the high-pressure chamber; and the annular groove has a width and a depth such that a sum of an area of a cross section of the annular passage in a circumferential direction and an area of a cross section of the annular groove in the circumferential direction is equal to or more than ½ of an area of a passage cross section of the fuel passage.

3. The fuel injection valve according to claim 1, wherein:

the nozzle body includes one of a pin groove and a pin hole, which engages with a pin that positions the nozzle body relative to the plate in a circumferential direction; and the one of the pin groove and the pin hole is displaced from the annular groove in a radial direction.

4. The fuel injection valve according to claim 1, wherein:

the annular groove has a width equal to or greater than a passage diameter of the fuel passage.

5. The fuel injection valve according to claim 1, wherein:

the plate includes a recess at the end surface of the plate facing toward the nozzle body; and the recess is displaced from the annular groove in a radial direction.

6. The fuel injection valve according to claim 1, wherein:

the plate is fixed with respect to the nozzle body.

7. The fuel injection valve according to claim 6, wherein the plate is fixed to the nozzle body by means of a threaded retaining nut.

8. The fuel injection valve according to claim 1, wherein:

fuel flows into the needle-receiving bore only through a combination of the fuel passage and the annular groove.

9. The fuel injection valve according to claim 1, wherein:

the needle is confined to the needle-receiving bore of the nozzle body so that the needle does not penetrate a plane of the plate.

10. The fuel injection valve according to claim 1, further comprising:

a spring that is received in the needle-receiving bore of the nozzle body, wherein the spring biases the nozzle toward the injection orifice, wherein the spring is confined to the needle-receiving bore.

11. A fuel injection valve comprising:

a nozzle body that includes:

an injection orifice, through which fuel is injected;

a needle that controls the injection through the injection orifice; and a needle-receiving bore that receives the needle, the needle-receiving bore being connected with the injection orifice; and a plate that is adjacently provided to the nozzle body, said plate having a fuel passage therein, through which fuel is supplied to the needle-receiving bore, wherein:

the plate has a groove, which directly connects the fuel passage with the needle-receiving bore, at a nozzle body-side end surface of the plate facing toward and directly contacting a plate-side end surface of the nozzle body; and the groove has a length in a circumferential direction and a width such that an area of an overlapping section between the needle-receiving bore and an opening portion of the groove is equal to or greater than an area of a passage cross section of the fuel passage, wherein the groove opens to the needle-receiving bore, wherein:

the annular groove has a radially outer peripheral wall which is located radially outward of an inner wall of the needle-receiving bore that defines an opening portion of said needle-receiving bore at said plate-side end surface of said nozzle body.

12. The fuel injection valve according to claim 11, wherein:

the overlapping section is a communicating section, through which the needle-receiving bore communicates with the opening portion of the groove.

13. The fuel injection valve according to claim 11, wherein:

the plate is fixed with respect to the nozzle body.

14. The fuel injection valve according to claim 13, wherein the plate is fixed to the nozzle body by means of a threaded retaining nut.

15. The fuel injection valve according to claim 11, wherein:

fuel flows into the needle-receiving bore only through a combination of the fuel passage and the annular groove.

16. The fuel injection valve according to claim 11, wherein:

the needle is confined to the needle-receiving bore of the nozzle body so that the needle does not penetrate a plane of the plate.

17. The fuel injection valve according to claim 11, further comprising:

a spring that is received in the needle-receiving bore of the nozzle body, wherein the spring biases the nozzle toward the injection orifice, wherein the spring is confined to the needle-receiving bore.

* * * * *